US011666201B2

(12) United States Patent
Kim et al.

(10) Patent No.: US 11,666,201 B2
(45) Date of Patent: Jun. 6, 2023

(54) DISHWASHER

(71) Applicant: LG Electronics Inc., Seoul (KR)

(72) Inventors: Daegyu Kim, Seoul (KR); Seunghun Kim, Seoul (KR); Ilhwan Kim, Seoul (KR); Sangheon Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 30 days.

(21) Appl. No.: 17/268,267

(22) PCT Filed: Aug. 13, 2019

(86) PCT No.: PCT/KR2019/010289
§ 371 (c)(1),
(2) Date: Feb. 12, 2021

(87) PCT Pub. No.: WO2020/036407
PCT Pub. Date: Feb. 20, 2020

(65) Prior Publication Data

US 2021/0307586 A1 Oct. 7, 2021

(30) Foreign Application Priority Data

Aug. 14, 2018 (KR) ..... 10-2018-0095017

(51) Int. Cl.
*A47L 15/48* (2006.01)
*A47L 15/42* (2006.01)

(52) U.S. Cl.
CPC ..... *A47L 15/486* (2013.01); *A47L 15/488* (2013.01); *A47L 15/4246* (2013.01); *A47L 2501/10* (2013.01); *A47L 2501/12* (2013.01)

(58) Field of Classification Search
CPC .. A47L 15/486; A47L 15/488; A47L 15/4246; A47L 2501/10; A47L 2501/12
See application file for complete search history.

(56) References Cited

U.S. PATENT DOCUMENTS 3,068,877 A * 12/1962 Jacobs ..... A47L 15/483 134/108
2004/0163686 A1* 8/2004 Kang ..... A47L 15/486 134/186

(Continued)

FOREIGN PATENT DOCUMENTS

CN 105796033 7/2016
CN 107440663 12/2017

(Continued)

OTHER PUBLICATIONS

International Search Report in International Appln. No. PCT/KR2019/010289, dated Dec. 17, 2019, 5 pages (with English translation).

(Continued)

*Primary Examiner* — Benjamin L Osterhout
(74) *Attorney, Agent, or Firm* — Fish & Richardson P.C.

(57) ABSTRACT

The present disclosure relates to a dishwasher. The dishwasher of the present disclosure includes a tub forming a washing chamber washing a washing target, a first circulation duct in which an air discharged from the tub flows, an outside air inflow duct in which an air from the outside flows, a fan assembly discharging the air thereto, passes through the first circulation duct and the outside air inflow duct, a second circulation duct heating and supplying a part of the air discharged from the fan assembly to the tub, an exhaust duct discharging a remaining part of the air discharged from the fan assembly to the outside.

10 Claims, 12 Drawing Sheets

(56) References Cited

U.S. PATENT DOCUMENTS

| | | | | |
|---|---|---|---|---|
| 2008/0264455 | A1* | 10/2008 | Brewer | A47L 15/483 134/95.2 |
| 2009/0211107 | A1* | 8/2009 | Laube | D06F 58/20 34/218 |
| 2010/0083991 | A1* | 4/2010 | Tolf | A47L 15/488 134/95.2 |
| 2013/0152981 | A1* | 6/2013 | Bertsch | A47L 15/0013 134/105 |
| 2014/0059880 | A1* | 3/2014 | Bertsch | A47L 15/0034 34/443 |
| 2014/0223761 | A1* | 8/2014 | Lee | A47L 15/483 34/218 |
| 2016/0022116 | A1 | 1/2016 | Delellis et al. | |
| 2019/0046004 | A1* | 2/2019 | Thiyagarajan | A47L 15/4225 |

FOREIGN PATENT DOCUMENTS

| | | |
|---|---|---|
| EP | 0239012 | 5/1990 |
| JP | H06277171 | 10/1994 |
| KR | 2015013760 2 | 12/2015 |
| KR | 101704612 | 2/2017 |

OTHER PUBLICATIONS

Office Action in Korean Appln. No. 10-2018-0095017, dated Oct. 24, 2022, 11 pages (with English translation).

* cited by examiner

DISHWASHER

CROSS-REFERENCE TO RELATED APPLICATIONS

This application is a National Stage application under 35 U.S.C. § 371 of International Application No. PCT/KR2019/010289, filed on Aug. 13, 2019, which claims the benefit of Korean Patent Application No. 10-2018-0095017, filed on Aug. 14, 2018. The disclosures of the prior applications are incorporated by reference in their entirety.

BACKGROUND OF THE INVENTION

1. Field of the Invention

The present invention relates to a dishwasher, more specifically, to a dishwasher that drives two fans by a single motor.

2. Description of the Related Art

A dishwasher is a device capable of washing dishes using water and detergent in a space where dishes can be stored and washing dishes through rinsing and drying processes. Foreign substances on the dishes can be removed by washing and rinsing with water and detergent. In addition, washing of the dishes may be finished through a drying process of removing water remaining on the dishes.

The drying process of the dishwasher is comprised of the process of increasing the temperature of the dishes by increasing the temperature of the water sprayed on the dishes and of promoting the evaporation of the water on the dishes, and the process of removing the evaporated vapor by condensing or absorbing in the cooling duct positioned in the inside or outside of the washing chamber.

When the humid air inside the tub of dishwasher is discharged to the outside, the dishes inside the dishwasher can be quickly dried. However, when humid air is discharged to the outside of the dishwasher, there is a problem in that mold or the like occurs due to a large amount of moisture flowing into the external space in which the dishwasher is disposed, the external elements are damaged.

In addition, in a structure for circulating the air inside the tub, a structure for circulating air inside the tub is disclosed using only one duct. When the air inside the tub is circulated by using a single duct, there is a problem that it takes a long time to dry.

SUMMARY OF THE INVENTION

The problem to be solved by the present invention is to provide a dishwasher capable of efficiently drying the inside of the tub by handling the humid air inside the tub.

Another problem of the present invention is to circulate the air of the tub by using a plurality of ducts and to maximize the drying effect by exchanging heat of circulating air. To flow the air to the plurality of ducts, a plurality of fans are needed. Here, another problem the present invention may solve is to provide a dishwasher that effectively drives a plurality of fans.

The problems of the present invention are not limited to the problems mentioned above, and other problems that are not mentioned will be clearly understood by those skilled in the art from the following description.

To solve above problem, the dishwasher, by including a tub forming a washing chamber inside thereof for washing dishes; a first fan discharging air in the washing chamber outward the tub and inducing the discharged air to flow to be supplied into the washing chamber; a second fan sucking air from an outside and then discharging the sucked outside air to the outside such that the air flown by the first fan and the sucked outside air are exchanging heat each other; a fan housing being provided with a first chamber forming a space in which the first fan is disposed and a second chamber, in which the second fan is disposed, forming a space under the first chamber; a fan motor disposed under the second chamber and rotating the first fan and the second fan, may use two fans to induce flow of air inside a plurality of ducts and may drive two fans by one motor.

A third chamber forming space, in which the fan motor is disposed, is formed in the fan housing, the third chamber is disposed under the second chamber to communicate with the second chamber. The fan motor is spaced apart from an upper end of the third chamber by a predetermined distance, so that air can be introduced from the third chamber to the second chamber.

The fan motor is connected with the first fan and the second fan by at least one axis to rotate the first fan and the second fan simultaneously. Two fans may be driven by one motor.

The first fan sucks air through a first inlet formed at an upper side of the first chamber, and discharges the air sucked by the first fan into a first outlet formed at one side of a peripheral surface of the first chamber, and the second fan sucks air of the third chamber through a second inlet formed at a lower side of the second chamber, and discharges the air sucked by the second fan into a second outlet formed at one side of a peripheral surface of the second chamber. Air may flow into the second chamber through the third chamber in which the fan motor is disposed.

The fan motor is spaced apart from the second inlet by a predetermined distance. Air may flow into the second chamber through the third chamber in which the fan motor is disposed.

The dishwasher further includes an outside air inflow duct in which air introduced from an outside of the cabinet (or outside) flow, wherein the third chamber connects the outside air inflow duct and the second chamber. Air introduced from the outside may flow into the second chamber through the third chamber.

A chamber partition plate, on which a second inlet communicating the second chamber and the third chamber is formed, is disposed between the second chamber and the third chamber, wherein the fan motor is spaced apart from the chamber partition plate by a predetermined distance. Air may flow into the second chamber through the third chamber in which the fan motor is disposed.

The fan housing further includes a fan motor fixing part for fixing the fan motor with the predetermined distance spacing apart from the chamber partition plate, wherein the fan motor includes a fastening member fixing a position of the fan motor by being fastened with the fan motor fixing part. The fan motor may be spaced apart and fixed from the upper end of the upper end of the third chamber.

The fan motor fixing part have a hook shape protruding downwardly from the chamber partition plate and is disposed in plural along a periphery of the second inlet. Wherein the fastening member is formed to protrude radially along a peripheral surface of an upper side of the fan motor. The fan motor may be spaced apart and fixed from the upper end of the upper end of the third chamber.

The dishwasher further includes a first circulation duct in which the air discharged outward the tub from the washing chamber flow; a second circulation duct conveying air in the first circulation duct to the washing chamber; a heat exchange duct in which the sucked outside air from the outside flow to exchange heat with the first circulation duct, wherein the first fan induces air inside the first circulation duct to flow to the second circulation duct, wherein the second fan induces the sucked outside air flowing into an inside of the cabinet from the outside to flow to the heat exchange duct.

Details of other embodiments are included in the detailed description and drawings.

According to the dishwasher of the present invention, there are one or more of the following effects.

First, the dishwasher of the present invention has the advantage of improving drying performance by circulating or exhausting the air inside the tub depending on the degree of humidity of the air inside the tub.

Second, by driving two fans using one fan motor, the inside air of each of the heat exchange duct and the circulation duct so that the power consumption reduces.

Third, the fan motor is spaced apart from the upper end of the third chamber, and can be hooked by the fan motor fixing part and the fastening member, thereby stably rotating the first fan and the second fan.

The effects of the present invention are not limited to the effects mentioned above, and other effects that are not mentioned will be clearly understood by those skilled in the art from the description of the claims.

DETAILED DESCRIPTION OF THE PREFERRED EMBODIMENTS

Advantages and features of the present disclosure, and a method of achieving them will become apparent with reference to the embodiments described below in detail together with the accompanying drawings. However, the present disclosure is not limited to the embodiments disclosed below but may be implemented in a variety of different forms. The present embodiments are provided to disclose completely the present disclosure and to fully inform the scope of the present disclosure to those who skilled in the art to which the present disclosure pertains. The disclosure is only defined by the scope of the claims. The same reference sign refers to the same elements throughout the whole specification.

Hereinafter, the present invention will be described with reference to the drawings for explaining a dishwasher according to an embodiment of the present invention.

<About the Composition of the Dishwasher>

Figure 1:
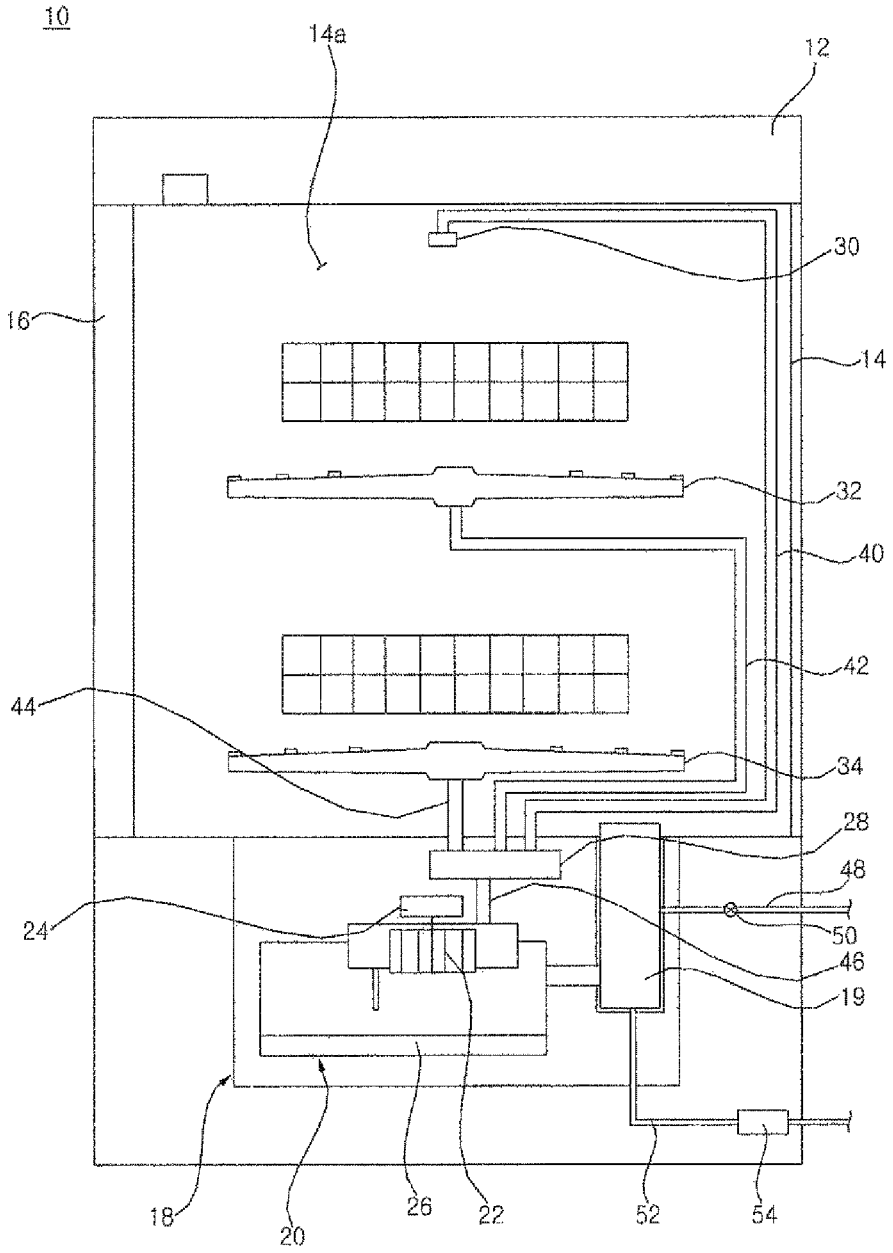
FIG. 1 is schematic front sectional view according to the one embodiment of the present invention.

FIG. 1 is schematic front sectional view according to the one embodiment of the present invention.

Referring to FIG. 1, the dishwasher 10 according to the present embodiment include a cabinet 12 forming the outer shape, a door 16 opening or closing the inside of the cabinet 12 and being coupled to the cabinet 12, a tub 14 installed inside of the cabinet 12 and having a washing chamber 14*a* washing the dishes disposed inside thereof. The cabinet 12 and the tub 14 have an opened front surface on which the door 16 is disposed.

The dishwasher 10 according to the present embodiment may include a dispenser (not shown) that stores detergent supplied by a user and provides the detergent into the tub 14 in the washing step. The dispenser may be disposed on the door 16.

The cabinet 12 according to the present embodiment form the outer shape, and one side thereof may be opened.

The tub 14 according to this embodiment is disposed inside of the cabinet 12. The tub 14 may form a space, between accommodating a heat exchange duct 80 and a circulation duct 60, 70 described later. A space in which a heat exchange duct 80 and a circulation duct 60, 70 are disposed may be formed between the cabinet 12 and the tub 14 according to the present embodiment. A circulation duct inflow hole 60*b* through which the air flows from the washing chamber 14*a* inside of the tub 14 to the circulation duct 60, 70 is formed on the upper surface of the tub 14 according to this embodiment. A circulation duct exhaust hole 64*b* through which the air flows from the circulation duct 60, 70 to the washing chamber inside of the tub 14 is formed on the lateral surface of the tub 14 according to this embodiment.

The dishwasher 10 according to this embodiment includes a rack 36, 38 accommodating the dishes and disposed inside the tub 14, a spraying nozzle 30, 32, 34 spraying the wash water towards the dishes accommodated on the rack 36, 38, a sump 18 supplying the wash water into the spraying nozzle 30, 32, 34, a washing pump 20 pumping the wash water stored in the sump 18 into a spraying module.

The racks 36, 38 include an upper rack 36 disposed in the upper part of the washing chamber 14*a*, a lower rack 38 disposed in the lower part of the washing chamber 14*a*. The spraying nozzle 30, 32, 34 may further include a top spraying nozzle 30 spraying the wash water and disposed in the upper part of the washing chamber 14*a*, an upper spraying nozzle 32 disposed between the upper rack 36 and the lower rack 38 and spraying the wash water into the upper rack 36 or into the upper rack 36 and the lower rack 38, a bottom nozzle 34 disposed under the lower rack 38 and spraying the wash water into the lower rack 38. Each of a plurality of spraying nozzles 30, 32, 34 may be connected to a plurality of connection pipe 40, 42, 44.

The washing pump 20 may include an impeller 22 rotating to supply the wash water inside the washing pump 20 to the plurality of spraying nozzles 30, 32, 34, a washing motor 24 rotating the impeller 22, and a heater 26 heating the wash water inside the washing pump 20. The wash water pumped from the washing pump 20 flows through a wash water supply pipe 46. A switching valve 28 connects at least one of the plurality of spraying nozzles 30, 32, 34 with the wash water supply pipe 46.

The dishwasher 10 according to this embodiment may include a water supply assembly supplying wash water into the dishwasher 10, a drainage assembly draining the water stored inside the dishwasher 10. The water supply assembly according to this embodiment may include a water supply pipe 48 forming a water supply flow path through which wash water is supplied from an external water source, a water supply valve 50 for opening and closing the water supply flow path formed in the water supply pipe 48, a flowmeter (not shown) measuring the flow rate of the wash water flowing into the sump 18 through the water supply flow path.

The drainage assembly according to this embodiment may be provided with a drainage pipe 52 having a drainage flow path guiding the water stored in the sump 18 to the outside thereof, a drainage pump 54 disposed on the drainage flow path formed in the drainage pipe 52 and drainages the washing water in the sump 18 to the outside. The drainage pump 54 may include a drainage motor (not shown) that generates rotational force.

Figure 2:
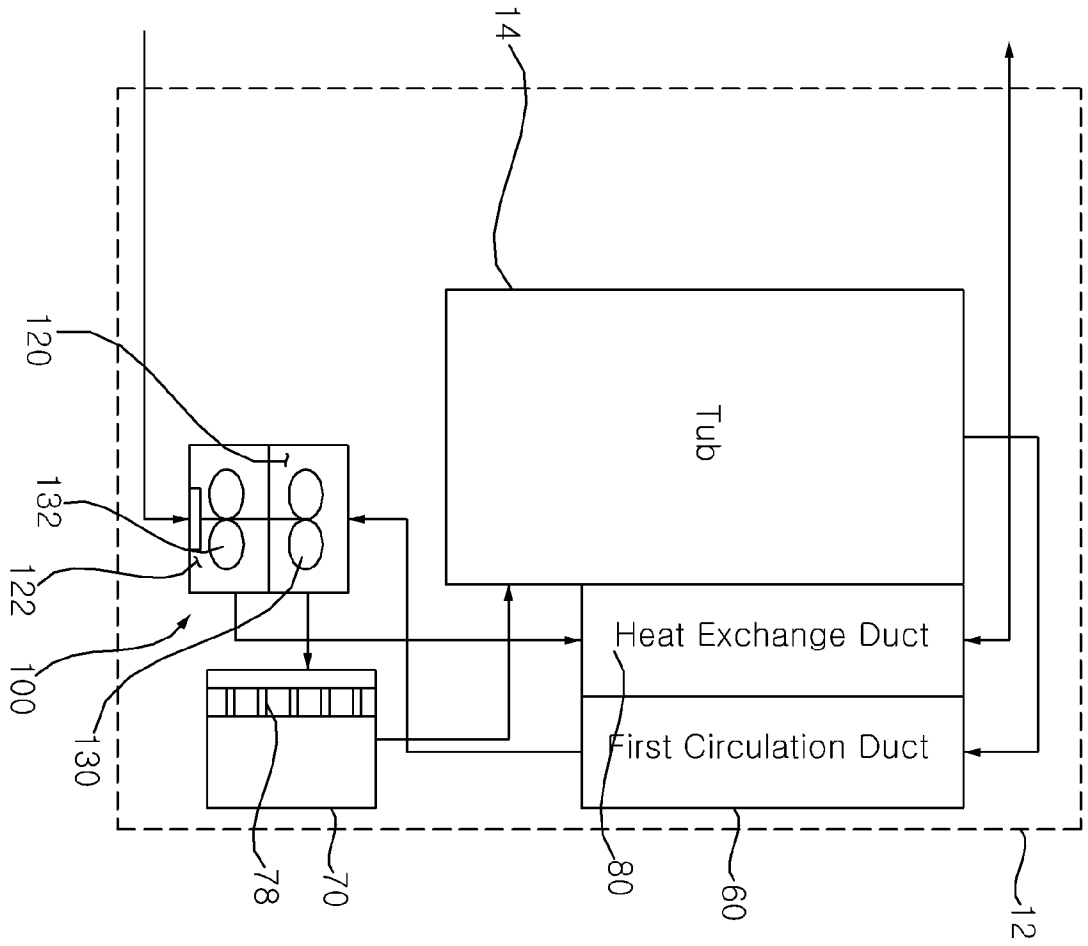
FIG. 2 is a schematic block diagram illustrating a flow of air in a dishwasher according to one embodiment of the present invention during a drying process.
Figure 3:
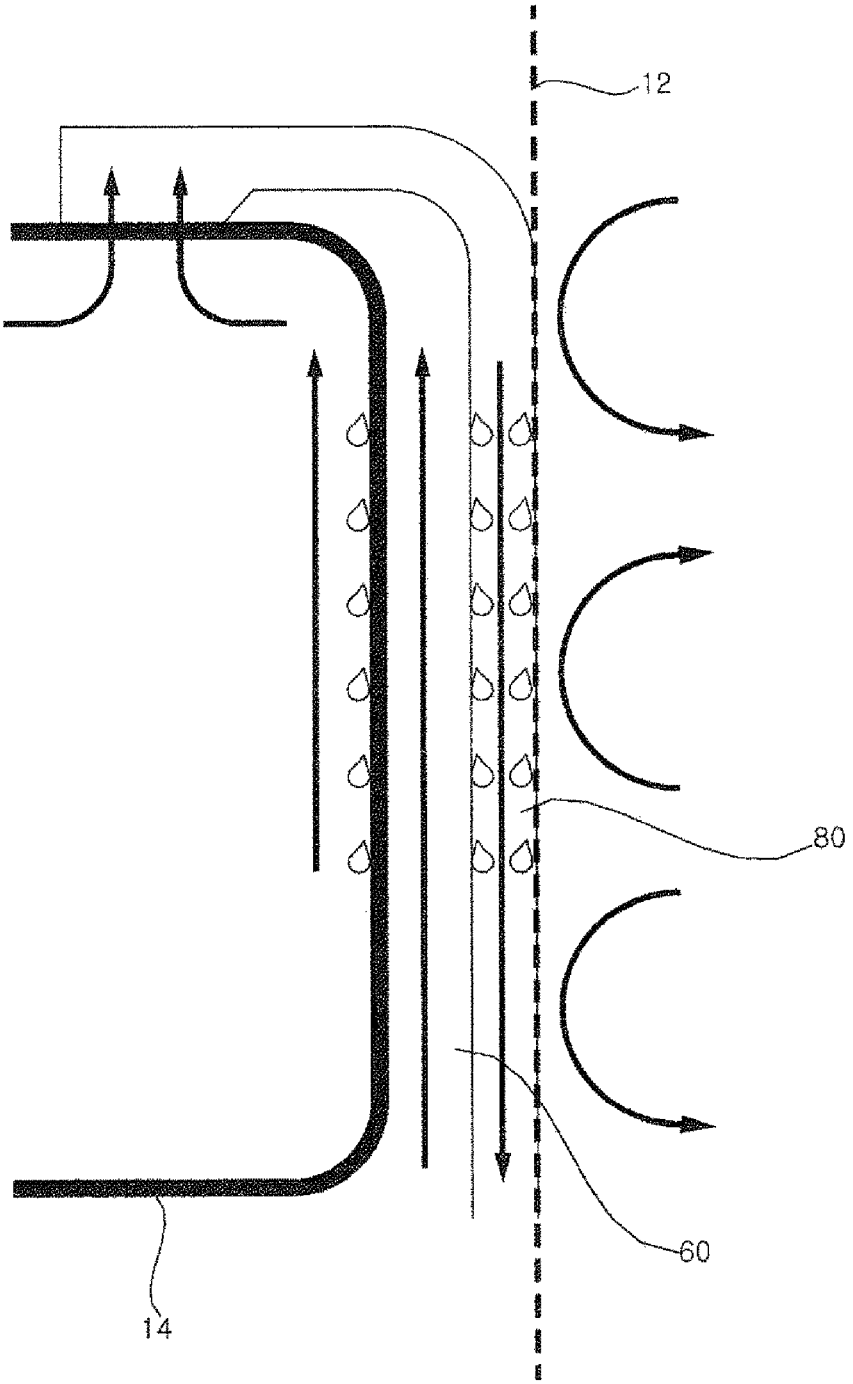
FIG. 3 is a drawing for explaining heat exchange occurring in air flowing through a tub, a circulation duct, and a heat exchange duct according to one embodiment of the present invention.
Figure 4:
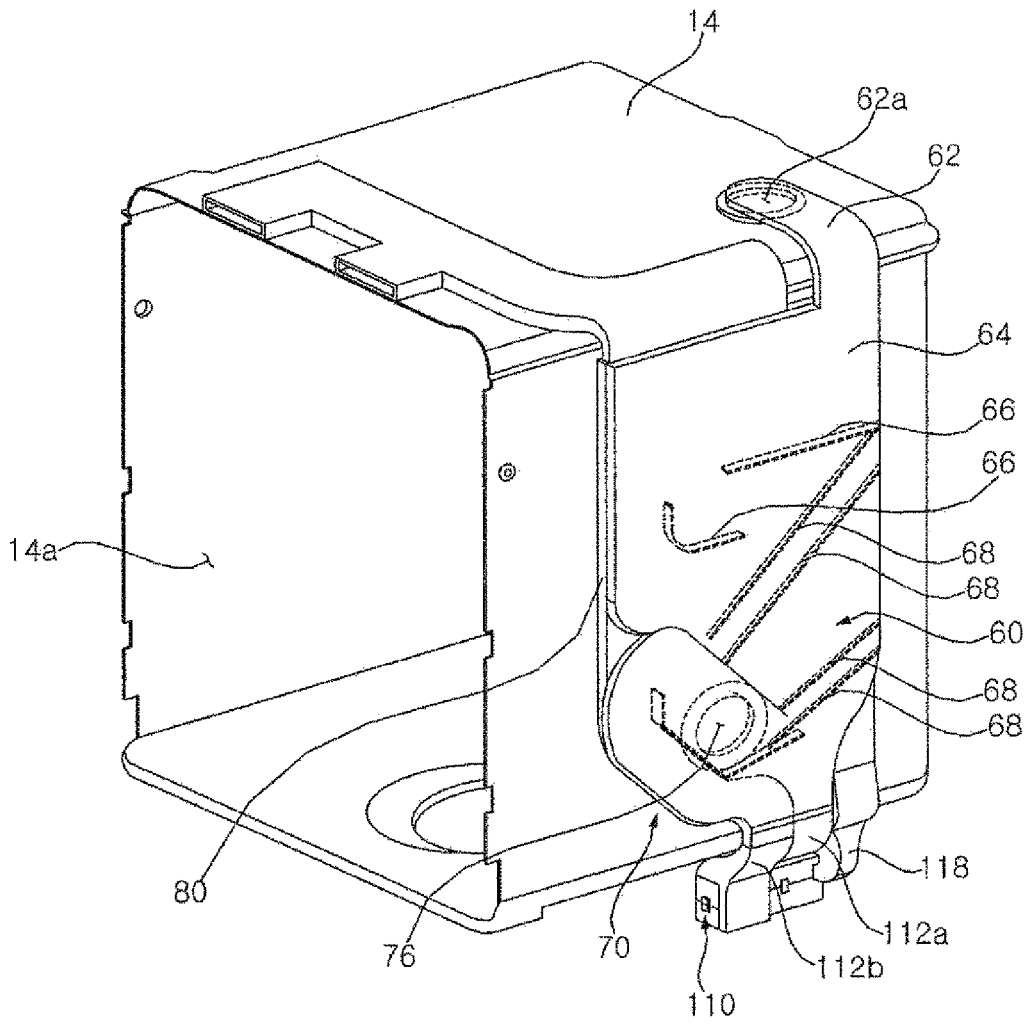
FIG. 4 is a drawing for explaining the configuration and disposition of the tub, a circulation duct, a heat exchange duct, and a fan assembly according to one embodiment of the present invention.
Figure 5:
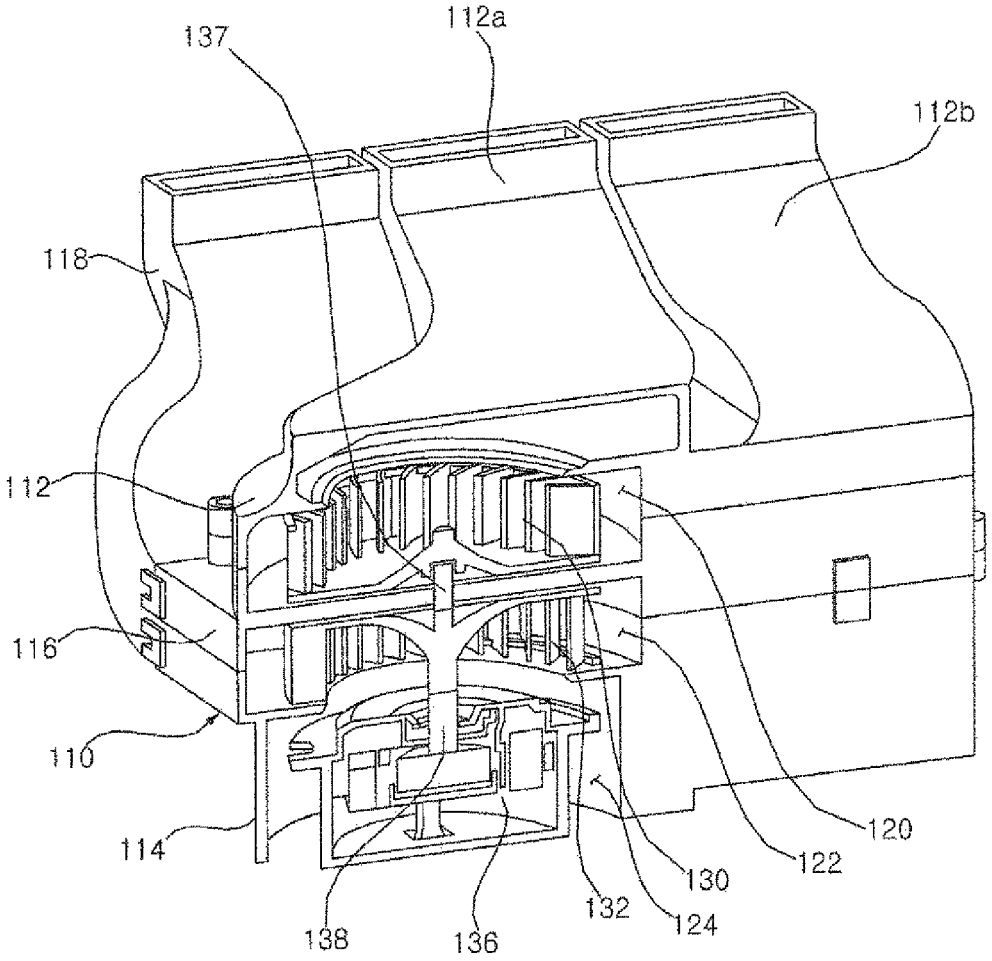
FIG. 5 is a cross-sectional view of one side of the fan assembly according to one embodiment of the present invention.

FIG. 2 is a block diagram for explaining the flow of air in the dishwasher according to one embodiment of the present invention during a drying process. FIG. 3 is a drawing for explaining heat exchange occurring in air flowing through the tub, the circulation duct, and the heat exchange duct according to one embodiment of the present invention. FIG. 4 is a drawing for explaining the configuration and disposition of the tub, the circulation duct, the heat exchange duct, and a fan assembly according to one embodiment of the present invention. FIG. 5A is a drawing for explaining a disposition of the outside air inflow duct according to one embodiment of the present invention. FIG. 5B is a view for explaining a disposition of an outside air inflow duct according to another embodiment of the present invention.

The dishwasher 10 according to the present embodiment includes the circulation ducts 60, 70 forming a space in which the air circulating inside the washing chamber 14*a* flows to the outside of the tub 14, the heat exchange duct 80 for exchanging heat with the circulation ducts 60 and 70 by introducing air from the outside of the cabinet 12, and the fan assembly 100 that forms the flow of air in the circulation ducts 60, 70 and the heat exchange duct 80.

The circulation duct 60, 70 includes a first circulation duct 60 heating the air discharged from the tub 14 with the heat exchange duct 80, a second circulation duct 70 heating the heat exchanged air and then supplies it to the washing chamber 14*a* inside the tub 14.

The first circulation duct 60 is disposed between the heat exchange duct 80 and the cabinet 12. The first circulation duct 60 according to this embodiment may exchange heat with the air, in the heat exchange duct 80, from the outside by being disposed to contact with the heat exchange duct in surface. Also, the first circulation duct 60 may exchange heat with the air flowing outside of the cabinet 12 by being disposed to contact with the cabinet in surface.

The first circulation duct 60 may include a heat exchange-circulation duct 64 disposed between the side of the tub 14 and the cabinet 12, a connection duct 62 conveying the air discharged from the tub 14 to the heat exchange-circulation duct 64.

The connection duct 62 connects the circulation duct inflow hole 62*a* formed on the upper side of the tub 14 and the heat exchange-circulation duct 64. A plurality of flow path guides 66 for guiding the flow of air may be formed inside the heat exchange-circulation duct 64. The flow guide 66 controls the speed of air flowing inside the heat exchange-circulation duct or makes the flow length longer so that effective heat exchange may be achieved.

The heat exchange-circulation duct 64 may include a plurality of condensate guides 68 that guide the condensate generated by heat exchange to the circulation duct exhaust hole 76. The plurality of condensed water guides 68 may be disposed on the one inner side and the other inner side of the heat exchange-circulation duct 64, respectively.

The second circulation duct 70 supplies the air that has completed heat exchange while passing through the first circulation duct 60 to inside the tub 14. A circulation part heater 78 may be disposed inside the second circulation duct 70. Accordingly, the air flowing inside the second circulation duct 70 may be heated by the circulation part heater 78 and then supplied into the tub 14.

The circulation duct exhaust hole 76 communicating with the cleaning chamber 14*a* inside the tub 14 is formed at an end of the second circulation duct 70. An upward flow path through which air flows upwardly is formed in the upstream of the circulation ducts 60, 70. A downward flow path through which air flowing upwardly flows downward is formed in the downstream of the circulation duct 60, 70. The circulation duct exhaust hole 76 is formed in the downstream of the downward flow path of the circulation ducts 60, 70. The circulation part heater 78 may be disposed in the upstream of the upward flow path. That is, the circulation part heater 78 is disposed under the upward flow path.

Accordingly, inflow of the wash water scattered from the washing chamber 14*a* inside tub 14 to the second circulation duct 70 into the circulation part heater 78 may be prevented.

The heat exchange duct 80 may be disposed between the side of the tub 14 and the first circulation duct 60. Accordingly, the air introduced from the outside passing through the heat exchange duct 80 may exchange heat with the first circulation duct 60. In addition, the air flowing through the heat exchange duct 80 may exchange heat with the air flowing through the washing chamber 14*a* inside the tub 14. Accordingly, the high-temperature and high-humidity air flowing through the washing chamber 14*a* of the tub 14 and the high-temperature and high-humidity air flowing through the first circulation duct 60 exchange heat with the outside air flowing through the heat exchange duct 80 to form the condensate.

A flow guide (not shown) may be separately formed inside the heat exchange duct 80.

The dishwasher 10 according to the present embodiment may include the exhaust duct 86 discharging the air has completed heat exchange in the heat exchange duct 80 to the outside of the cabinet 12. The exhaust duct 86 is disposed above the tub 14 and may discharge air to the front of the cabinet 12.

The air flowing into the cabinet 12 from the outside may flow in the heat exchange duct 80 through an outside air inflow duct 140*a*, 140*b*. The outside air inflow ducts 140*a*, 140*b* according to the present embodiment may be connected with a third chamber 124 described below. Therefore, the outside air flowing into the outside air inflow ducts 140*a* and 140*b* may flow to the second chamber 122 through the third chamber 124, and then may flow to the heat exchange duct 80 by the rotation of a second fan 132.

Figure 7A:
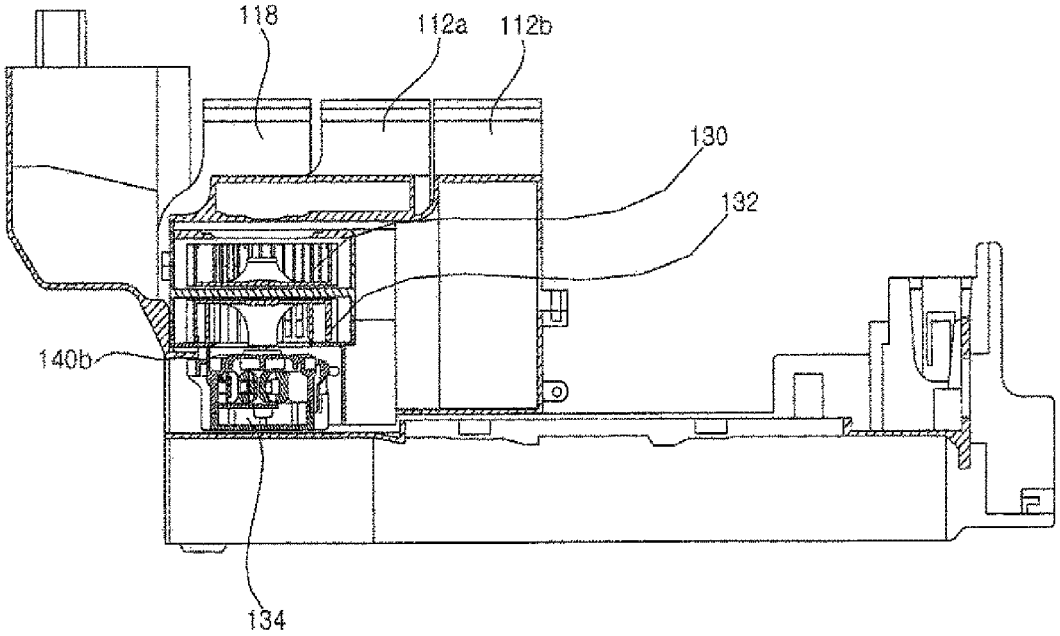
FIG. 7A is a drawing for explaining a disposition of an outside air inflow duct according to one embodiment of the present invention.
Figure 7B:
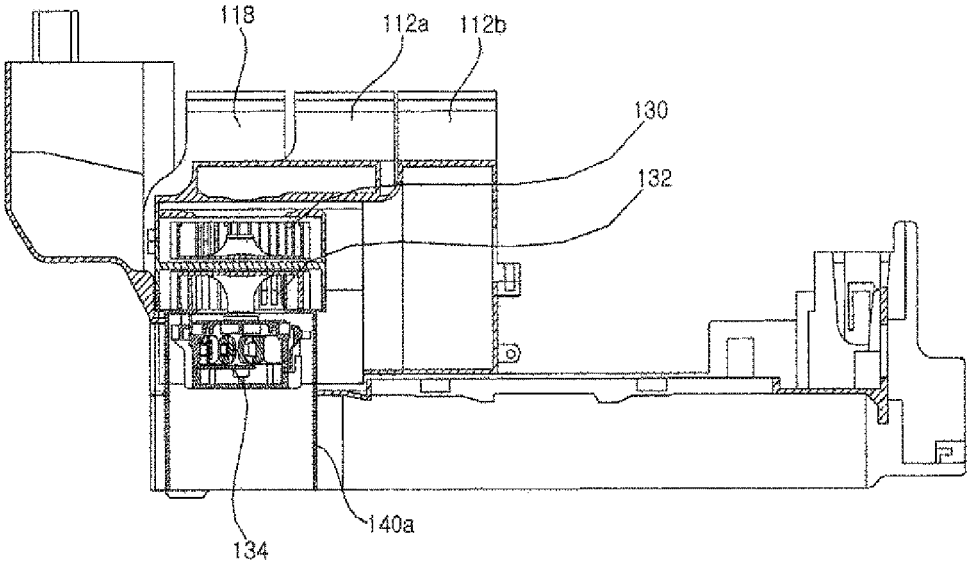
FIG. 7B is a view for explaining a disposition of an outside air inflow duct according to another embodiment of the present invention.

Referring to FIG. 7*a*, the outside air inflow duct 140*a* may be formed on one side of the peripheral surface where a fan motor 134 of the fan assembly 100 is disposed. In this case, the outside air may be introduced from the rear of the cabinet 12. Referring to FIG. 7*b*, the outside air inflow duct 140*b* may be disposed under the fan assembly 100. In this case, the outside air may be introduced into the cabinet 12 through the bottom of the cabinet 12. In addition, it is also possible to form the inlet in front side of the bottom of the cabinet 12 or to form the inlet in the space between the tub 14 and the cabinet 12.

The fan assembly 100 may convey the flowing air in the first circulation duct 60 to the second circulation duct 70 and may convey the air flowing into the inside of the cabinet 12 from the outside to the heat exchange duct 80.

A first chamber 120 communicating the first circulation duct 60 and the second circulation duct 70 and a second chamber 122 for communicating the external air inflow ducts 140*a* and 140*b* and the heat exchange duct 80 is formed inside the fan assembly 100 according to this embodiment. A first fan 130 inducing the air in the first circulation duct 60 to flow to the second circulation duct 70 may be disposed in the first chamber 120. The second fan 132 inducing the air in the outside air inflow duct 140*a*, 140*b* to flow to the heat exchange duct 80 may be disposed in the second chamber 122. In addition, the fan assembly 100 may include the fan motor 134 that simultaneously rotates the first fan 130 and the second fan 132. The fan assembly 100 according to this embodiment is disposed under the tub 14. The fan assembly 100 according to the present embodiment has a structure in which two fans 130, 132 are driven by the one fan motor 134. The detailed configuration of the fan assembly 100 will be described below.

Figure 6:
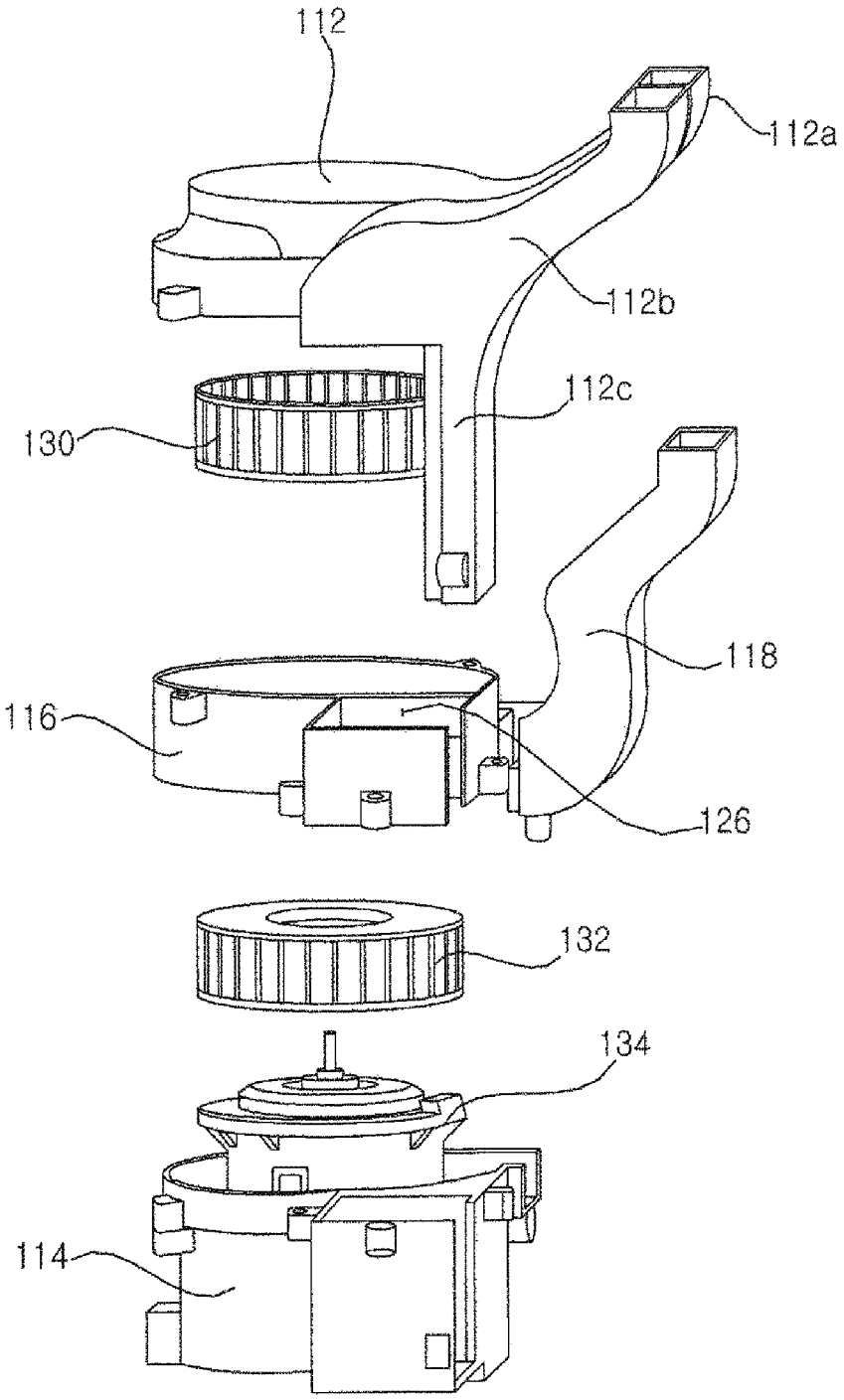
FIG. 6 is an exploded perspective view of a fan assembly according to one embodiment of the present invention.
Figure 8:
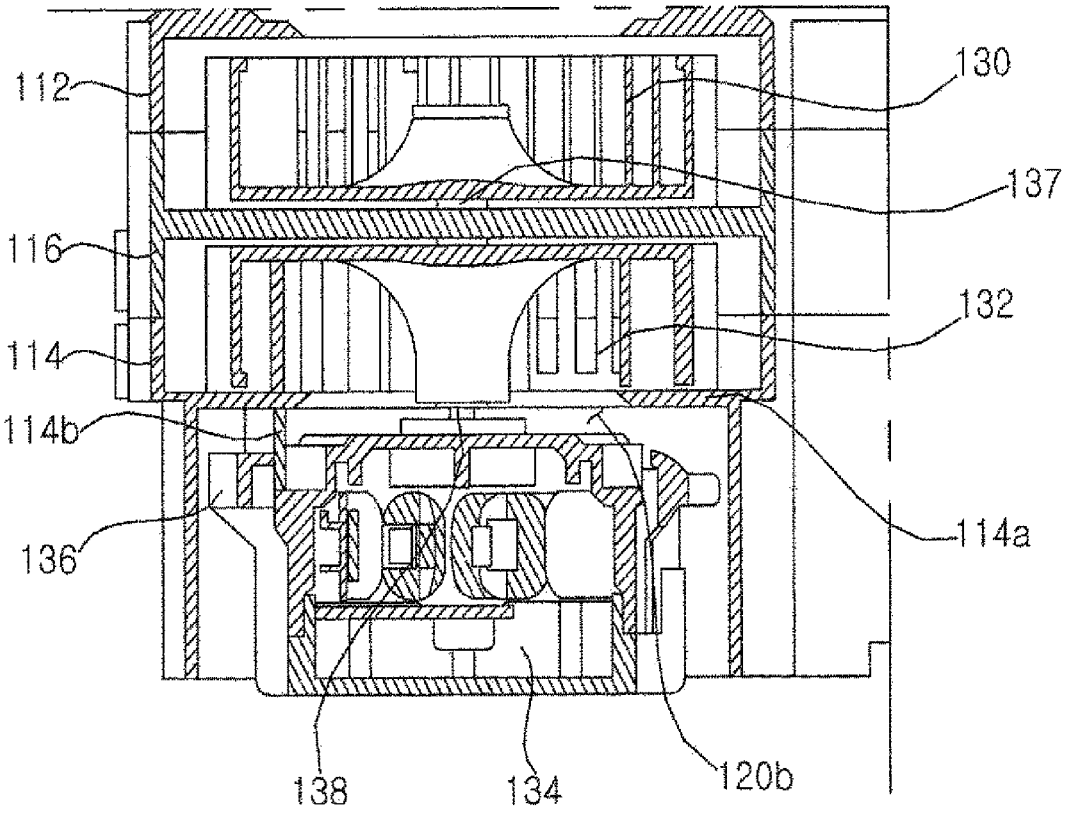
FIG. 8 is a side cross-sectional view of one side of the fan assembly for explaining the inside of the fan assembly according to one embodiment of the present invention.
Figure 9:
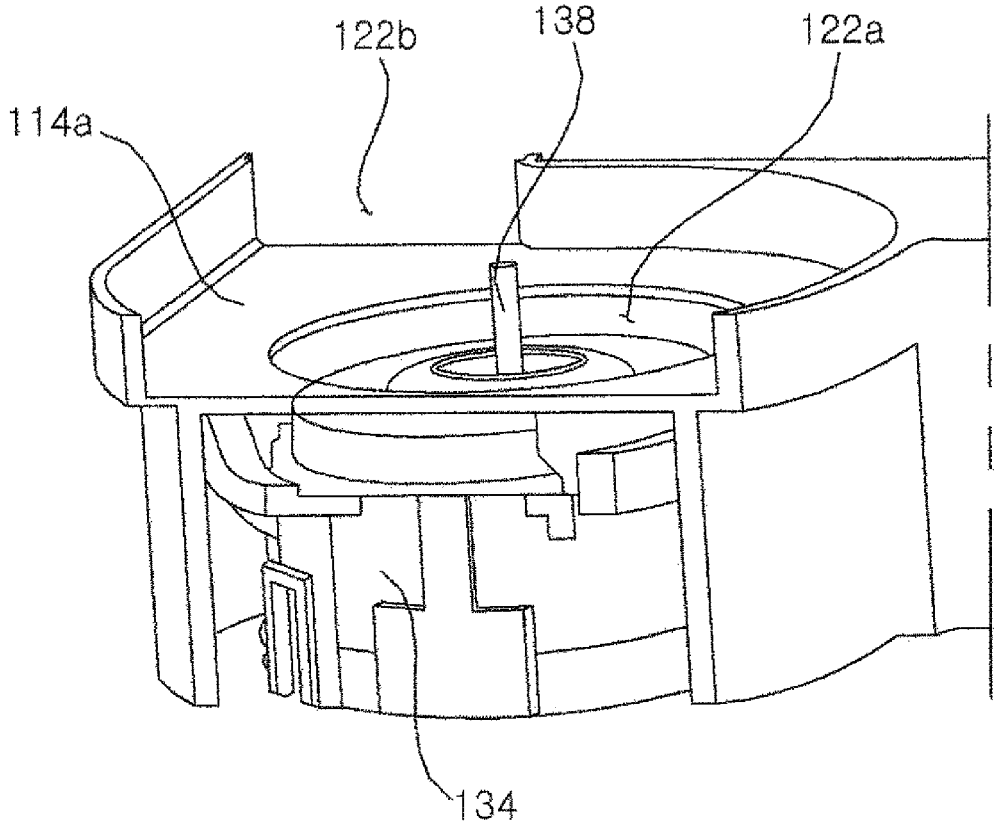
FIG. 9 is a cross-sectional view of one side of the fan housing for explaining the coupling relationship between the fan assembly and the fan housing according to one embodiment of the present invention.
Figure 10A:
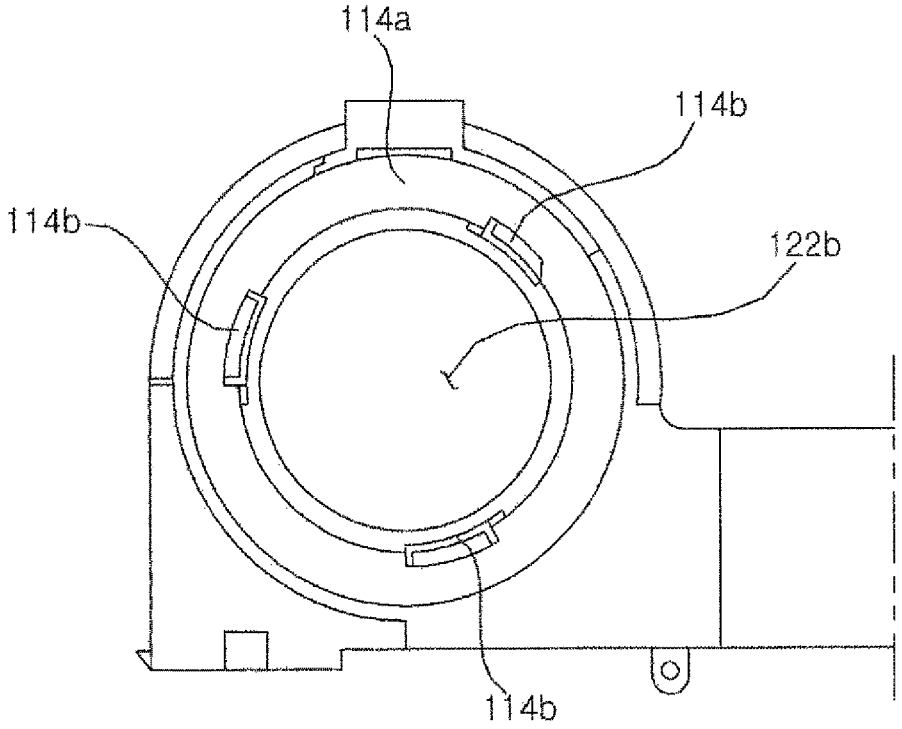
FIG. 10A is a view showing the bottom side of the lower cover of the fan housing according to an embodiment of the present invention.
Figure 10B:
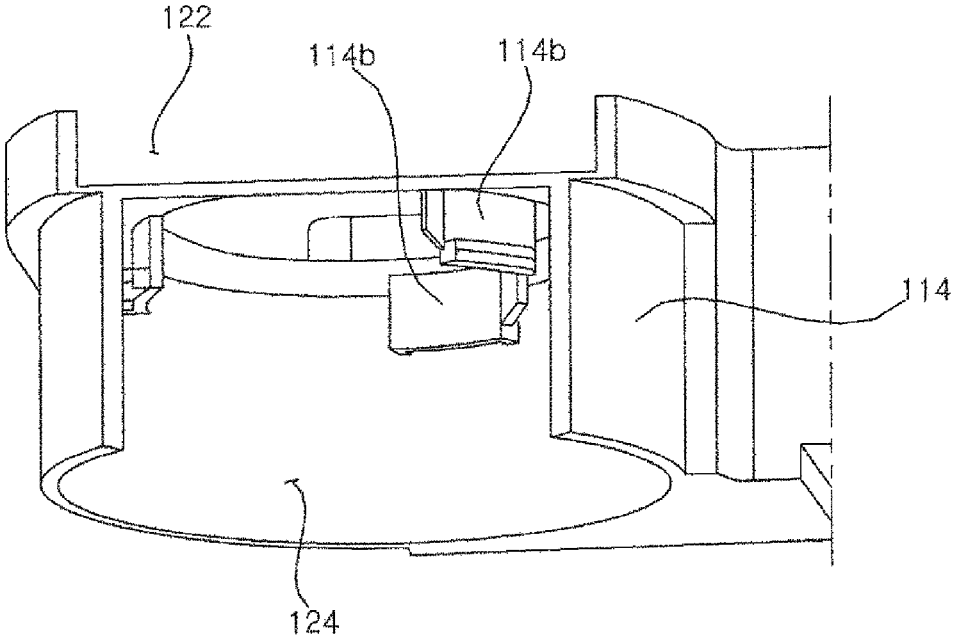
FIG. 10B is a cutaway view of one side of the lower cover of the fan housing according to one embodiment of the present invention.

FIG. 6 is a cross-sectional view of one side for explaining the inside of the fan assembly according to the one embodiment of the present invention. FIG. 7 is an exploded perspective view of the fan assembly according to the one embodiment of the present invention. FIG. 8 is a cross-sectional view of one side of the fan assembly for explaining the inside of the fan assembly according to the one embodiment of the present invention. FIG. 9 is a drawing for explaining the coupling relationship of the fan motor and the fan housing according to the one embodiment of the present invention. FIG. 10A is a drawing showing the bottom side of the lower cover of the fan housing according to the one embodiment of the present invention. FIG. 10B is a cutaway view of one side of the lower cover of the fan housing according to one embodiment of the present invention.

Referring to FIGS. 6 to 10, the fan assembly according to the present embodiment will be described below.

The fan assembly 100 according to the present embodiment includes a fan housing 110 forming the first chamber 120 communicating with the first circulation duct 60 and the second circulation duct 70 and forming the second chamber 122 in which outside air flows in and communicates with the heat exchange duct 80, the first fan 130 disposed inside the first chamber 120 and inducing the air in the first circulation duct 60 to flow to the second circulation duct 70, the second fan 132 disposed inside the second chamber 122 to flow air flowing into the cabinet 12 from the outside to the heat exchange duct 80, and the fan motor 134 disposed on one side of the first fan 130 or the second fan 132 and rotating the first fan 130, the second fan 132.

The first chamber 120 and the second chamber 122 disposed inside the fan housing 110 may be disposed up and down. The first chamber 120 according to the present embodiment is disposed above the second chamber 122. In the fan housing 110 according to the present embodiment, a third chamber 124 in which the fan motor 134 is disposed may be formed under the second chamber.

A first inlet 120*a* communicating with the first circulation duct 60 is formed above the first chamber 120.

A first outlet 120*b* communicating with the second circulation duct 70 is formed on the one side of peripheral surface of the first chamber 120.

A second inlet 122*a* to which air introduced from the outside of the cabinet 12 flows is formed under the second chamber 122. A second outlet 122*b* communicating with the heat exchange duct 80 is formed on the one side of the peripheral surface of the second chamber 122. The second inlet 122*a* according to the present embodiment communicates the second chamber 122 and the third chamber 124. The third chamber 124 may be connected to the outside air inflow ducts 140*a* and 140*b*.

A third inlet 124*a* to which the outside air flows may be formed in the bottom or the peripheral surface of the third chamber 124. The third inlet 124*a* may be designed in consideration of the disposition of the outside air inflow duct. Therefore, when the outside air inflow duct 140*a* is disposed behind the third chamber 124 as shown in FIG. 7*a*, the third inlet 124*a* may be formed on one side of the peripheral surface of the third chamber 124. In addition, when the outside air inlet duct 140*b* is disposed below the third chamber 124 as shown in FIG. 7*b*, the third inlet port 124*a* may be formed below the third chamber 124.

The first chamber 120 and the second chamber 122 are disposed up and down with a central cover 116 interposed therebetween, and the internal space thereof is not communicated with each other. The second chamber 122 and the third chamber 124 are disposed up and down and are disposed to communicate with each other. A chamber partition plate 114*a* in which the second outlet is formed is disposed between the second chamber 122 and the third chamber 124. When operation of the fan motor 134 begins, the air inside the third chamber 124 flows into the second chamber 122 due to the rotation of the second fan 132.

The fan housing 110 includes an upper cover 112 forming an upper part of the first chamber 120, a lower cover 114 forming the lower part of the second chamber 122, and the central cover 116 disposed between the upper cover 112 and the lower cover 114 to partition the first chamber 120 and the second chamber 122.

By combining the upper cover 112 and the central cover 116, the first chamber 120 is formed. By combining the upper cover 112 and the central cover 116, an exhaust chamber 126 that conveys air discharged from the first chamber 120 to the second circulation duct 70 may be formed. The upper cover 112 may further include a fastening part 112*c* that is fastened or fixed to the central cover 116 and the lower cover 114. The fastening part 112*c* may be elongated downward from a second circulation duct-connection part 112*b* described below.

The exhaust chamber 126 according to the present embodiment is disposed in front of the first chamber 120. The first chamber 120 and the exhaust chamber 126 may communicate with each other through the first outlet 120*b*. The exhaust chamber 126 may be formed in a direction in which the first outlet 120*b* is formed in the first chamber 120. The second chamber 122 is formed by the coupling of the central cover 116 and the lower cover 114.

The lower cover 114 includes a fan motor fixing part 114*b* that fixes the fan motor 134 at a predetermined distance from the chamber partition plate 114*a*. The fan motor fixing part 114*b* is disposed on the periphery of the second inlet 122*a* and protrudes downward from the bottom surface of the chamber partition plate 114*a*. The fan motor fixing part 114*b* may have a hook shape protruding downward from the chamber partition plate 114*a*. The fan motor fixing part 114*b* may fix the fan motor 134 by being fastened to a fastening member 136 of the fan motor 134 described below. The fan motor fixing part 114*b* according to the present embodiment may be formed along the periphery of the second inlet 122*a* in plural. The plurality of fan motor fixing parts 114*b* may be spaced apart from each other along the periphery of the second inlet 122*a*.

The fan assembly 100 may further include a first circulation duct-connection part 112*a* connecting the first chamber 120 and the first circulation duct 60, the second circulation duct-connection part 112*b* connecting the first chamber 120 and the second circulation duct 70, a heat exchange duct-connection part 118 connecting the second chamber 122 and the heat exchange duct 80. The first circulation duct-connection part 112*a* and the second circulation duct-connection part 112*b* may be formed with the upper cover 112 as one body. The first circulation duct-connection part 112*a*, the second circulation duct-connection part 112*b* and the heat exchange duct-connection part 118 according to the present embodiment may be disposed in the front-rear direction at the lower side of the tub. According to the present embodiment, the first circulation duct-connection part 112*a*, the second circulation duct-connection part 112*b* and the heat exchange duct-connection part 118 are disposed in the front-rear direction at the lateral side of the bottom of the tub.

The heat exchange duct-connection part 118 is connected with the heat exchange duct 80 by being extended to the left and to the top from the lower cover 114 and the central cover 116 forming a periphery of the second chamber 122. The heat exchange duct-connection part 118 according to the present embodiment is disposed behind the first circulation duct-connection part 112*a* and the second circulation duct-connection part 112*b*.

The second circulation duct-connection part 112*b* is connected with the second circulation duct 70 by being extended forward and upward from the left side of the upper cover 112 or the central cover 116 forming a periphery of the first chamber 120. The second circulation duct-connection part 112*b* is connected to the first chamber 120 through the exhaust chamber 126. The second circulation duct-connection part 112*b* connects the exhaust chamber 126 and the second circulation duct 70.

The first circulation duct-connection part 112*a* forms a space, above the first chamber 120, communicating with inlet. The first circulation duct-connection part 112*a* extends so as to be disposed between the second circulation duct-connecting part 112*b* and the heat exchange duct-connecting part 118.

The second circulation duct-connection part 112*b*, the first circulation duct-connection part 112*a* and the heat exchange duct-connection part 118 are disposed sequentially from the front at the lateral side of the bottom of the tub 14. The first fan 130 and the second fan 132 rotate around a rotation axis formed up and down. The rotation axis rotating the first fan 130 and the rotation axis rotating the second fan 132 may be formed on the same line.

The first fan 130 and the second fan 132 according to the present embodiment may use a centrifugal fan that introduces air from one surface parallel to the rotation axis and discharges air in a peripheral direction perpendicular to the rotation axis.

The first fan 130 according to the present embodiment circulates air inside the tub 14 to the outside of the tub 14. The second fan 132 according to the present embodiment discharges air introduced thereinto from the outside of the cabinet 12 to the outside of the cabinet 12 by exchanging heat with air circulating at the outside of the tub 14.

The fan assembly 100 according to this embodiment may include a first rotation axis 137 connecting the first fan 130 and the second fan 132, a second rotation axis 138 connecting the second fan 132 and the fan motor 134. The first rotation axis 137 and the second rotation axis 138 may be formed as one body. The first rotation shaft 137 may connect the first fan 130 and the second fan 132 by passing through the central cover 116.

The fan motor 134 according to the present embodiment is disposed in the third chamber 124. The fan motor 134 according to the present embodiment rotates the first fan 130 and the second fan 132 simultaneously. The fan motor 134 is disposed at a predetermined distance downward from the second inlet 122*a*. The fan motor 134 is disposed downwardly to be spaced apart from the second inlet 122*a* by a predetermined gap.

The fan motor 134 includes the fastening member 136 that is fastened to the fan motor fixing part 114*b* to fix the position of the fan motor 134. The fastening member 136 according to the present embodiment is formed to protrude radially outward along the upper peripheral surface of the fan motor 134. The fastening member 136 according to the present embodiment may be formed in plural. The plurality of fastening members 136 are installed at positions corresponding to the plurality of fan motor fixing portions 114*b*.

In the above, preferred embodiments of the present disclosure have been illustrated and described, but the present disclosure is not limited to the specific embodiments described above. The present disclosure can be implemented in various modifications by those who skilled in the art to which the present disclosure belongs without getting out of the point of the present disclosure in the claims. These modified implementations should not be individually understood from the technical idea or perspective of the present disclosure.

What is claimed is:

1. A dishwasher comprising:

a cabinet;

a tub that is disposed in the cabinet and that defines a washing chamber configured to receive one or more objects to be washed, the tub having a circulation duct inflow hole defined at a first side of the washing chamber and a circulation duct exhaust hole defined at a second side of the washing chamber;

a first circulation duct disposed between the cabinet and the tub and configured to receive air discharged through the circulation duct inflow hole;

a second circulation duct disposed between the cabinet and the tub and configured to provide air to the circulation duct exhaust hole;

an outside air inflow duct disposed between the cabinet and the tub and configured to receive air from an outside of the cabinet;

a heat exchange duct disposed between the cabinet and the tub and configured to guide air to thereby enable heat exchange between the air in the heat exchange duct and the air in the first circulation duct; and a fan assembly configured to cause air to flow in each of the first circulation duct, the second circulation duct, the outside air inflow duct, and the heat exchange duct, the fan assembly comprising:

a first fan configured to cause air to flow from the first circulation duct to the second circulation duct, a second fan configured to cause air to flow from the outside air inflow duct to the heat exchange duct, a fan housing including a first chamber that accommodates the first fan and a second chamber that accommodates the second fan, the second chamber being disposed below the first chamber, and a fan motor disposed below the second chamber and configured to rotate the first fan and the second fan.

2. The dishwasher according to the claim 1, wherein the fan housing further includes a third chamber that accommodates the fan motor, the third chamber being disposed below the second chamber and configured to communicate with the second chamber, and wherein the fan motor is spaced apart from an upper end of the third chamber by a predetermined distance.

3. The dishwasher according to the claim 1, wherein the fan motor is connected with the first fan and the second fan by at least one axis and configured to rotate the first fan and the second fan simultaneously.

4. The dishwasher according to the claim 2, wherein the fan housing further includes:

a first inlet defined at an upper side of the first chamber;

a first outlet defined at a peripheral surface of the first chamber;

a second inlet defined at a lower side of the second chamber; and a second outlet defined at a peripheral surface of the second chamber, wherein the first fan is configured to receive air through the first inlet and to discharge the air to the first outlet, and wherein the second fan is configured to receive air from the third chamber through the second inlet and to discharge the air to the second outlet.

5. The dishwasher according to the claim 4, wherein the fan motor is spaced apart from the second inlet by a predetermined distance.

6. The dishwasher according to the claim 2, wherein the third chamber connects the outside air inflow duct and the second chamber.

7. The dishwasher according to the claim 2, wherein the fan housing further includes:

a first inlet defined above the first chamber and configured to communicate with the first circulation duct; and a chamber partition plate that is disposed between the second chamber and the third chamber, the chamber partition plate defining a second inlet configured to communicate with the second chamber and the third chamber, and wherein the fan motor is spaced apart from the chamber partition plate by a predetermined distance.

8. The dishwasher according to the claim 7, wherein the fan housing further includes a fan motor fixing part that fixes the fan motor at a position spaced apart from the chamber partition plate by the predetermined distance, and wherein the fan motor includes a fastening member that is fastened with the fan motor fixing part and fixes the position of the fan motor.

9. The dishwasher according to the claim 8, wherein the fan motor fixing part has a hook shape protruding downwardly from the chamber partition plate, the fan motor fixing part being one of a plurality of fan motor fixing parts that are arranged along a periphery of the second inlet.

10. The dishwasher according to the claim 9, wherein the fastening member protrudes radially along a peripheral surface of an upper side of the fan motor.

* * * * *